US005772404A

United States Patent [19]

Carella et al.

[11] Patent Number: 5,772,404

[45] Date of Patent: Jun. 30, 1998

[54] COMPACT GETTER PUMP WITH NESTED THERMALLY INSULATING SHIELDS

[75] Inventors: Sergio Carella, Varese; Andrea Conte, Milan; Fortunato Belloni, Villastanza Di Parabiago, all of Italy

[73] Assignee: SAES Getters S.p.A., Milan, Italy

[21] Appl. No.: 678,395

[22] Filed: Jul. 2, 1996

[30] Foreign Application Priority Data

Jul. 10, 1995 [IT] Italy ..... MI950486 U

[51] Int. Cl.[6] ..... F04B 37/02

[52] U.S. Cl. ..... 417/51; 417/313

[58] Field of Search ..... 417/48, 49, 50, 417/51, 313

[56] References Cited

U.S. PATENT DOCUMENTS

| | | | |
|---|---|---|---|
| 2,965,218 | 12/1960 | Jayne . | |
| 3,167,678 | 1/1965 | Griessel . | |
| 3,603,704 | 9/1971 | Zucchinelli | 417/51 |
| 3,662,522 | 5/1972 | Della Porta et al. | 417/51 |
| 3,780,501 | 12/1973 | Porta et al. | 55/208 |
| 3,961,897 | 6/1976 | Giorgi et al. | 417/51 |
| 4,137,012 | 1/1979 | Della Porta et al. | 417/51 |
| 4,209,752 | 6/1980 | Bridges | 330/4 |
| 4,492,110 | 1/1985 | Bergquist | 73/40.7 |
| 4,512,721 | 4/1985 | Ayres et al. | 417/51 |
| 4,515,528 | 5/1985 | Young | 417/51 |
| 4,571,158 | 2/1986 | Maegdefessel | 417/51 |
| 5,154,582 | 10/1992 | Danielson | 417/51 |
| 5,161,955 | 11/1992 | Danielson et al. | 417/51 |
| 5,320,496 | 6/1994 | Manini et al. | 417/51 |
| 5,324,172 | 6/1994 | Manini et al. . | |

FOREIGN PATENT DOCUMENTS

| | | | |
|---|---|---|---|
| 0 144 522 A2 | 6/1985 | European Pat. Off. . | |
| 0 364 916 A1 | 9/1990 | European Pat. Off. . | |
| 0 644 576 A2 | 3/1995 | European Pat. Off. . | |
| 2 363 714 | 3/1978 | France | 37/2 |
| 4-5480 | 1/1992 | Japan . | |
| WO94/02958 | 2/1994 | WIPO . | |

*Primary Examiner*—Timothy Thorpe
*Assistant Examiner*—Peter G. Korytnyk
*Attorney, Agent, or Firm*—Hickman & Martine, LLP

[57] ABSTRACT

A compact getter pump, compatible with size limitations of portable apparatus is described. In one embodiment a getter device and a heating apparatus capable of heating getter elements to a desired temperature, are contained within a thermally insulating housing comprised of a plurality of nested thermally insulating shields with an open end. The open end of at least one of the shields is covered with a particle trap. In another embodiment, each of the nested thermally insulating shields is of a substantially cylindrical shape and is substantially coaxially disposed along an axis defined by the heating apparatus. In one embodiment a plurality of getter elements and a heating apparatus are enclosed by three nested evenly spaced cylindrical metal shields that have open ends and are coaxially disposed along an axis defined by the getter elements and the heating apparatus. The open end of the metal shield closest to the getter elements is covered by a wire mesh screen whose apertures are of larger size than the apertures of the wire mesh screen covering the open end of the adjacent metal shield.

18 Claims, 2 Drawing Sheets

COMPACT GETTER PUMP WITH NESTED THERMALLY INSULATING SHIELDS

CLAIM OF FOREIGN PRIORITY PURSUANT TO 35 U.S.C. § 119

This application claims priority under 35 U.S.C. § 119 from Italian Patent Application Serial Number MI 95/U 000486, filed Jul. 10, 1995, which is incorporated herein by reference for all purposes.

BACKGROUND OF THE INVENTION

1. The Field of the Invention

The present invention relates to devices and materials for the production and maintenance of vacuums. In particular, the present invention relates to getter pump devices for producing vacuums and the activation and maintenance of such getter pumps. More specifically, the present invention provides compact getter pump devices for maintaining high vacuum condition.

2. The Background Art

There are a number of processes which require ultra-high vacuum levels of, for example, $10^{-7}$ to $10^{-12}$ Torr. For example, high vacuum physics machines such as cyclotrons and linear accelerators often require a vacuum of the order of $10^{-8}$–$10^{-12}$ Torr. Also, in the semiconductor manufacturing industry, ultra-high vacuums of approximately $10^{-7}$–$10^{-9}$ Torr are often required in semiconductor processing equipment.

Several pumps are often used in series or parallel to achieve ultra-high vacuum levels within a chamber. A mechanical (e.g., oil) pump is often used to reduce the pressure within a chamber to approximately 30–50 millitorr. These are often referred to as "high pressure" pumps since they only pump relatively high pressure gasses. Then, a high- or ultra-high vacuum pump, such as a molecular pump, cryopump, turbo pump, or the like, is used to reduce the pressure to approximately $10^{-7}$–$10^{-9}$ Torr. These are often referred to as "low pressure" pumps since they pump low pressure gasses. The pump-down time for a particular chamber can range from minutes to hours to days depending upon such factors as the size of the chamber, the capacity of the pumps, the conductance from the chamber to the pumps, and the desired final pressure.

In certain ultra-high vacuum applications, getter pumps have been used in conjunction with the aforementioned mechanical, molecular, and cryopumps. Getter pumps have been used in vacuum technology for achieving high vacuum states for about thirty years. These types of pumps are not mechanical; rather, they comprise metals and metal alloys that sorb various gas molecules such as carbon oxides ($CO_x$, where x is 1 or 2), hydrogen ($H_2$), nitrogen ($N_2$), and water ($H_2O$). Particularly useful are non-evaporable getter ("NEG") materials, which include zirconium- or titanium-based alloys in combination with elements such as aluminum, vanadium, iron, nickel or other transition elements or their combinations. Examples of getter materials include the alloy having the composition Zr 84%-Al 16% by weight, which is manufactured and sold by SAES Getters S.p.A. (Milan, Italy) under the name "St 101®", and the alloy having the composition Zr 70%-V 24.6%-Fe 5.4% by weight, also manufactured and sold by the SAES Getters under the tradename "St 707". Getter pumps are much appreciated for their lack of moving mechanical parts since they do not require lubricants which could contaminate the vacuum chamber or must be changed periodically. The lack of moving mechanical parts also means that getter pumps do not transmit vibrations to delicate components that may be present in the vacuum chamber in addition to the getter pumps.

The active elements of getter pumps can be produced by adhering the NEG material in powder to a suitable support, e.g., by rolling the getter material on the surface of a metallic strip. Getter pumps of this variety are described, for example, in U.S. Pat. No. 4,137,012 and in the published Japanese Patent Application Serial No. JP-A-04/45480, both of which are incorporated herein by reference. More recently, getter pumps comprising getter elements that are bodies of sintered powders of NEG materials have been described, e.g., in U.S. Pat. Nos. 5,320,496 and 5,324,172, and in U.S. patent applications Ser. Nos. 08/332,564, 08/348,798, 08/477,100, and 08/521,943. Each of these patents and patent applications is incorporated herein by reference for all purposes.

Regardless of the construction and materials of the getter pump, the getter materials should be kept at temperatures of at least about 400° C. to achieve good performance characteristics. Furthermore, NEG getter materials require an initial "activation" treatment at temperatures of up to about 900° C. for periods between about 10–30 minutes. As a consequence, it has been found desirable to include a high powered heating device capable of heating the getter elements to their optimum activation and operating temperatures integrated into the getter pump.

The size and location of the heating device relative to the getter material are important parameters for pump operation, especially for smaller pumps. U.S. patent application Ser. No. 08/625,538, incorporated herein by reference for all purposes, describes placement of a heating device adjacent the getter elements where the support of the getter elements also houses the heating member. However, despite this design improvement, small getter pumps for use in portable apparatus are frequently unavailable because of the power requirements and size of the requisite heating device.

Therefore, it is desirable to provide an arrangement whereby the power requirements and size of the heating device of a getter pump are reduced while retaining optimum heating efficiency and range. Furthermore, it is desirable to provide an arrangement wherein getter pumps suitable for use in portable instruments can be readily constructed.

SUMMARY OF THE INVENTION

The present invention provides, in one aspect, a compact getter pump, whose size and power requirements are reduced through housing a getter device and heating apparatus with a plurality of nested thermally insulating shields that minimize heat dissipation from the getter device. The apparatus of the invention is thus compatible with the size limitations often found in portable instruments. Thus, the present invention will be seen to provide a compact getter pump that avoids the above described problems in getter pump design.

In one embodiment, the present invention provides a getter device contained within a thermally insulating housing comprised of a plurality of nested thermally insulating shields and a heating apparatus capable of heating getter elements to a requisite temperatures. According to this embodiment, the thermally insulating shields possess an open end and effectively prevent heat dissipation from the heating apparatus and the getter elements. In another embodiment, the open end of at least one of the nested thermally insulating shields is covered with a particle trap. In still another aspect, each of the nested thermally insulating shields comprises a substantially cylindrical shape that is substantially coaxially disposed along an axis defined by the heating apparatus.

In one particular embodiment, a getter device and heating apparatus are contained within a housing comprised of a plurality of nested thermally insulating shields where the open ends of the innermost of the thermally insulating shields are covered with a wire mesh screen. In one particular embodiment, the apertures of the wire mesh screen covering the open end of the first thermally insulating shield are larger than the apertures of the wire mesh screen covering the second thermally insulating shield.

In another aspect, a plurality of getter elements and a heating apparatus are enclosed by three nested evenly spaced cylindrical metal shields. Each of the shields has an open end and is coaxially disposed along an axis defined by the getter elements and the heating apparatus. In one embodiment, the open end of the metal shield closest to the getter elements is covered by a wire mesh screen of 30–40 mesh and the open end of the adjacent metal shield is covered by a wire mesh screen of 320–400 mesh.

These and other aspects and advantages of the present invention will become more apparent when the Description below is read in conjunction with the accompanying Drawings.

DESCRIPTION OF SPECIFIC EMBODIMENTS

Figure 1:
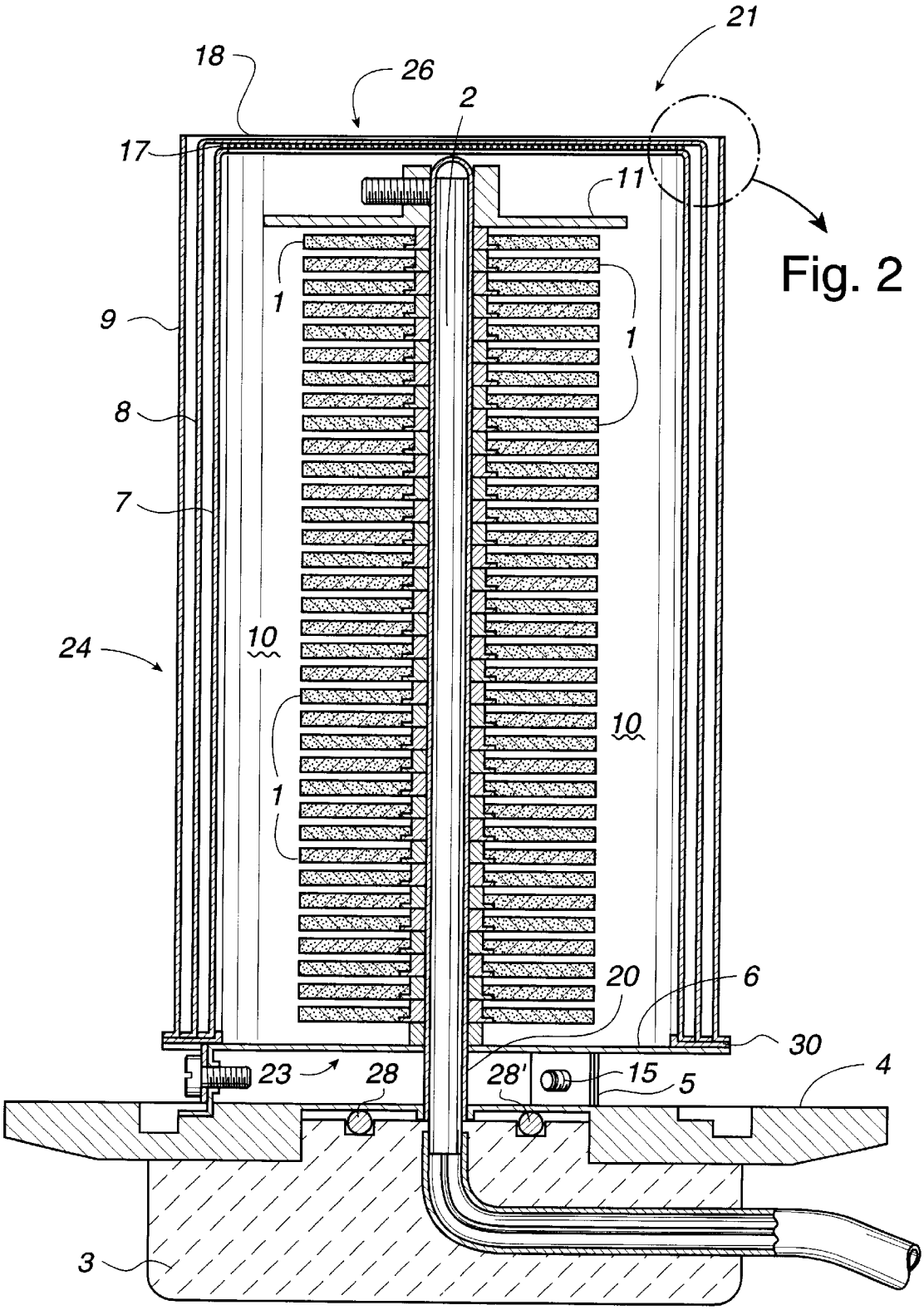
FIG. 1 is a sectional view of a getter pump constructed in accordance with one embodiment of the present invention.

A cross section of one embodiment of a compact getter pump provided by the present invention is illustrated in detail in FIG. 1. Getter pump 21 comprises a thermally insulating housing 24 comprised of a plurality of nested thermally insulating shields (three in the illustrated embodiment) 7, 8, and 9. Each shield, 7, 8, and 9 has an open and closed end shown generally at 26 and 23 respectively. In one embodiment, support 6 is connected to a flange 4 by supporting brackets 5 through bolts or screws 15. The interior volume 10 of the getter pump is defined by the inner wall of innermost shield 7, support 6 and the exterior wall of sheath 20 in one embodiment. Disks of non evaporable getter elements 1 form a getter device that is substantially coaxially disposed around heating apparatus 2, housed within sheath 20, for heating the getter elements to a desired temperature, e.g., for activation of the getter material. Heating apparatus 2 is mounted on a first flange 3 while the portion of the wall of the getter pump forming the sheath 20 is mounted on flange 4 in one embodiment. O-rings and other sealing means, such as shown at 28, 28' and 30 can be used to further sealingly isolate the inner volume 10 of the getter pump.

The plurality of nested thermally insulating shields 7, 8 and 9 allows for the use of small heating devices of limited power that are able to maintain the getter elements 1 at operating temperatures by preventing substantial heat transfer from interior volume 10 to the surroundings of the getter pump. In one embodiment, nested thermally insulating shields 7, 8 and 9 are made of thin sheets of metal, e.g., nickel or steel, of between about 0.1 mm to about 1.0 mm thickness. In another embodiment, the interior surfaces of one or more of shields 7, 8 and 9 are polished to increase their thermal reflectivity and thus further reduce heat dissipation from the getter pump. In one embodiment, the shields are evenly spaced at distances that, depending on the size of the apparatus, vary from about 1.0 mm to about 3.0 mm. In one particular embodiment, the shields are spaced evenly at a distance of about 1.0 mm. In general, about three shields are adequate for most applications. However, at the low end of the getter element operating temperature range two thermal shields may suffice. Conversely, at the high end of the getter element operating temperature range, four or more thermally insulating shields may be used. In general, any number of shields can be arranged about the getter device and heating apparatus with the only restriction being size considerations. The materials and construction methods to form compact getter pump 21 will be known to those of skill in the getter pump arts.

Figure 2:
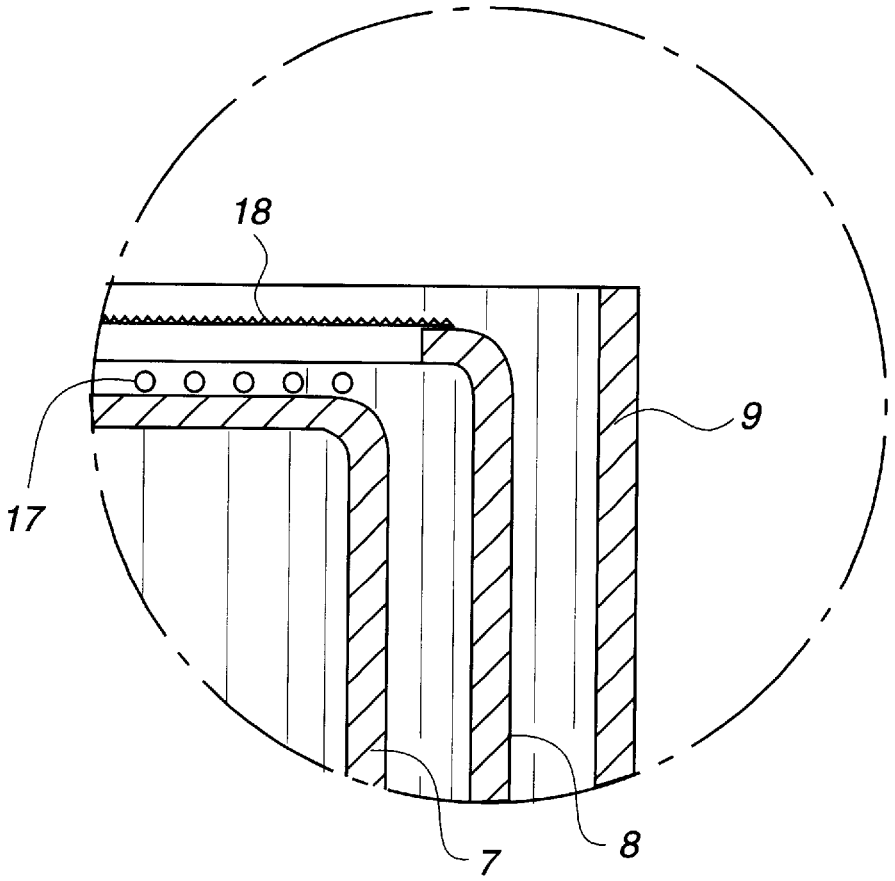
FIG. 2 is a magnified sectional view of the open end of the housing of one embodiment of a getter pump constructed in accordance with of present invention.

Opposite support 6, near a deflector 11 that is at the top of the stack of getter elements 1, are the open ends of the plurality of nested thermally insulating shields 7, 8 and 9 as indicated generally at 26. In one embodiment, shown in FIG. 2, wire mesh screens 17 and 18 cover the open ends of shields 7 and 8 respectively thus separating the getter device from the rest of the evacuated volume and providing a particle trap that prevents loose particles of getter material from leaving the getter pump and potentially damaging components in the evacuated chamber. In general, the mesh size of screens 17 and 18 will be between about 30 and 500 mesh. The open end of the third thermally insulating shield 9 is left unrestricted. In one embodiment when the number of thermally insulating shields in the getter pump is two or greater, the two first shields will have a wire mesh screen at their open end.

In the illustrated embodiment, innermost wire mesh screen 17 operates as a coarse filter to trap the largest getter element particles. In one embodiment, wire mesh screen 17 is composed of thick metallic wire of diameter similar to cylindrical tube 7, e.g., a mesh size of about 30–40 mesh. A heavier gauge wire is preferred for the innermost shield because a thinner gauge wire could potentially melt from contact with large, heated getter element particles. The next innermost wire mesh screen 18 serves as a fine particle filter and is consequently comprised of a thin metallic wire of 320–400 mesh to retain any small getter element particles that pass through the innermost wire mesh screen 17. In one embodiment, outermost shield 9 is uncovered to provide greater conductance between the getter device and the volume being evacuated. Other particle trap arrangements will be apparent to those skilled in the getter pump arts.

Although a certain embodiment has been used to describe the present invention, it will be apparent to those having skill in the art that various changes can be made to this embodiment without departing from the scope or spirit of the present invention. For example, it will be appreciated from the foregoing that the arrangement of getter elements 1 within volume 10 may be changed and the thermal shields can be mounted in a different fashion. For example, strips of getter material mounted on a concertina-shaped support can be used instead of the illustrated getter disks. Also, heating apparatus 2 can be mounted adjacent the getter device. In addition, the thermally insulating shields can be of any shape and/or arrangement effective to thermally insulate the getter device. For example, the shields can have a substantially rectangular shape as described in the above incorporated co-pending U.S. patent applications Ser. Nos. 08/521,943 and 08/348,798. In addition, a wide variety of getter pump designs and getter materials are known to those of skill in the vacuum and getter pump arts that can be applied to the present invention as described herein.

What is claimed:

1. A compact getter pump, comprising a getter device contained within a thermally insulating housing, said housing including a plurality of nested thermally insulating shields, a particle trap coupled with at least one of said plurality of nested thermally insulating shields, and a heating apparatus for heating said getter device to a desired temperature, wherein each of said thermally insulating shields includes an open end, said particle trap comprises a wire mesh screen substantially covering said open end of at least one of said plurality of nested thermally insulating shields, and said plurality of nested thermally insulating shields are effective to reduce heat dissipation from said heating apparatus and said getter device.

2. The compact getter pump of claim 1, wherein said housing comprises first and second thermally insulating shields, the open ends of said shields being substantially covered by said wire mesh screen with said first shield being substantially closer to said getter device than said second shield, the apertures of the wire mesh screen covering the open end of said first thermally insulating shield comprising a larger size than the apertures of the wire mesh screen covering the open end of said second thermally insulating shield.

3. The compact getter pump of claim 1, wherein each of said plurality of thermally insulating shields comprises a substantially cylindrical shape and each of said thermally insulating shields being substantially coaxially disposed along an axis defined by said heating apparatus.

4. The compact getter pump of claim 3, wherein each thermally insulating shield of said plurality of thermally insulating shields comprises a thickness of about 0.1 mm to about 1.0 mm.

5. The compact getter pump of claim 4, wherein each thermally insulating shield of said plurality of thermally insulating shields comprises a thermally reflective interior surface.

6. The compact getter pump of claim 5, wherein each of said thermally insulating shields comprises a material selected from the group consisting of nickel and stainless steel.

7. The compact getter pump of claim 6, wherein each of said thermally insulating shields comprises a polished surface.

8. The compact getter pump of claim 3, wherein said plurality of nested thermally insulating shields comprises three thermally insulating shields.

9. The compact getter pump of claim 8, wherein said wire mesh screen substantially covers the open ends of the innermost two of said three thermally insulating shields that are closest to said getter device.

10. The compact getter pump of claim 9, wherein the mesh size of said wire mesh screen is between about 30 mesh and about 500 mesh.

11. The compact getter pump of claim 10, wherein the mesh size of the innermost wire mesh screen is between about 30 mesh and about 40 mesh.

12. The compact getter pump of claim 11, wherein the mesh size of the next innermost wire mesh screen is between about 320 mesh and about 400 mesh.

13. The compact getter pump of claim 8, wherein the distance between each of said three nested thermally insulating shields is between about 3.0 mm and about 1.0 mm.

14. The compact getter pump of claim 13, wherein the distance between each of said three nested thermally insulating shields is about 1.0 mm.

15. A compact getter pump, comprising a getter device and a heating apparatus contained within a housing of a plurality of nested, thermally, insulating shields, each of said plurality of nested, thermally, insulating shields including an open end, the open end of the innermost of said plurality of thermally insulating shields being covered with a wire mesh screen.

16. The compact getter pump of claim 15, wherein said housing comprises first and second thermally insulating shields, the open ends of said shields being substantially covered by said wire mesh screen with said first thermally insulating shield being substantially closer to said getter device than said second thermally insulating shield, the wire mesh screen covering the open end of said first thermally insulating shield comprising a smaller mesh size than the wire mesh screen covering the open end of said second thermally insulating shield.

17. The compact getter pump of claim 16, wherein said housing comprises three thermally insulating shields, said thermally insulating shields being evenly spaced at about 1.0 mm to about 3.0 mm of separation between adjacent shields.

18. A compact getter pump, comprising a plurality of getter elements and a heating apparatus, housed within three nested evenly spaced cylindrical thermally insulating metal shields, said shields being coaxially disposed along an axis defined by said getter elements and said heating apparatus, each of said shields including an open end, the open end of the innermost of said shields being covered with wire mesh screen of 30–40 mesh and the open end of the next innermost of said shields being covered with wire mesh screen of 320–400 mesh.

* * * * *